US006578389B1

(12) United States Patent
Okamoto et al.

(10) Patent No.: US 6,578,389 B1
(45) Date of Patent: Jun. 17, 2003

(54) KNITTING METHOD FOR DISPOSING UNUSED YARN EDGE

(75) Inventors: Kazuyoshi Okamoto, Gose (JP); Hideyuki Okawa, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/048,976

(22) PCT Filed: Aug. 28, 2000

(86) PCT No.: PCT/JP00/05815

§ 371 (c)(1),
(2), (4) Date: Feb. 14, 2002

(87) PCT Pub. No.: WO01/16416

PCT Pub. Date: Mar. 8, 2001

(30) Foreign Application Priority Data

Aug. 31, 1999 (JP) ..... 11-245646

(51) Int. Cl.[7] ..... D04B 7/04

(52) U.S. Cl. ..... 66/64

(58) Field of Search ..... 66/64, 65, 66, 66/67, 68, 69, 70, 71

(56) References Cited

U.S. PATENT DOCUMENTS 2,307,607 A * 1/1943 Snader ..... 66/202
5,467,616 A 11/1995 Loquet et al.
5,520,020 A 5/1996 Okuno

FOREIGN PATENT DOCUMENTS

JP 7-324259 A 12/1995

* cited by examiner

*Primary Examiner*—Danny Worrell
(74) *Attorney, Agent, or Firm*—Rothwell, Figg, Ernst & Manbeck

(57) ABSTRACT

A knitting method for disposing an unused yarn edge produced in yarn-in or a yarn-out operation. The knitting method includes forming that two or more unused-yarn-edge disposal loops are from the knitting yarn introduced in and/or drawn out in knitting a knitted fabric by using an empty needle around an end side of a knitted fabric body; and moving the unused-yarn-edge disposal loops thus formed and laying each disposal loop over loops of different courses of the knitted fabric body located at an end side thereof in knitting the next course of the knitted fabric body. This knitting method allows the unused yarn edge to be held in the knitted fabric by the loops of the knitted fabric, and as such can allow the unused yarn edge to be disposed by simply cutting it at its portion close to the knitted fabric, without the need of the linking.

5 Claims, 8 Drawing Sheets

KNITTING METHOD FOR DISPOSING UNUSED YARN EDGE

CROSS REFERENCE TO RELATED APPLICATION

This application is a 35 USC 371 National Phase Entry Application from PCT/JP00/05815, filed Aug. 28, 2000, and designating the U.S.

TECHNICAL FIELD

The present invention relates to a knitting method for disposing an unused yarn edge produced in the yarn-in operation in which a knitting yarn is newly introduced in knitting a knitted fabric by using a flat knitting machine and/or in the yarn-out operation in which the knitting yarn used in knitting is withdrawn from the knitting.

BACKGROUND ART

When the yarn-in operation wherein a knitting yarn is newly introduced in knitting is performed by using a flat knitting machine, an unused yarn edge on the yarn-in side is produced between an edge of the newly introduced knitting yarn in the knitting and the first loop of the knitted fabric body formed by that knitting yarn. Similarly, when the yarn-out operation wherein the knitting yarn used in the knitting is withdrawn from the knitting is performed, an unused yarn edge on the yarn-out side is produced between an edge of the knitting yarn withdrawn from the knitting and the final loop formed by that knitting yarn. After the completion of knitting, those unused yarn edges are disposed by cutting them at their portions close to the knitted fabric and also linking them into the knitted fabric with crochet needles. This disposing way of linking the unused yarn edges into the knitted fabric with crochet needles takes a lot of trouble and also has difficulties with fine stitches.

It is the objective of the present invention to eliminate the need of linking the unused yarn edges into the knitted fabric with the crochet needles mentioned above.

DISCLOSURE THE INVENTION

In the light of the problem mentioned above, the present invention provides a knitting method for disposing an unused yarn edge produced in yarn-in and/or yarn-out of a knitting yarn used in knitting a knitted fabric by using a flat knitting machine having at least a pair of front and back needle beds, either or both of which are movable in a longitudinal direction thereof, the knitting method comprising (a) the step that two or more unused-yarn-edge disposal loops are formed from the knitting yarn introduced in and/or drawn out in knitting by using an empty needle around an end side of a knitted fabric body; and (b) the step that the unused-yarn-edge disposal loops thus formed are moved and laid in order, one each, to and over loops of different courses of the knitted fabric body located at an end side thereof in knitting the next course of the knitted fabric body. According to the constitution of the present invention mentioned above, an unused yarn edge portion of the knitting yarn introduced in and/or drawn out in knitting is formed in the form of unused-yarn-edge disposal loops, which are then moved and laid in order, one each, to and over loops of different courses of the knitted fabric body located at an end side thereof, while the knitted fabric body is knitted. As a result of this, the unused yarn edge is allowed to extend in the lengthwise direction of the knitted fabric in the state of being interwoven into the knitted fabric at the end side of the knitted fabric.

In the knitting method, the unused yarn edge to be disposed is the unused yarn edge on the yarn-in side produced in the yarn-in and the unused-yarn-edge disposal loops formed from the unused yarn edge are laid over the loops of the knitted fabric body in order of from a finally formed unused-yarn-edge disposal loop to a firstly formed unused-yarn-edge disposal loop, which is one of the characteristic features of the present invention. Alternatively, the unused yarn edge to be disposed may be the unused yarn edge on the yarn-out side produced in the yarn-out and the unused-yarn-edge disposal loops formed from the unused yarn edge may be laid over the loops of the knitted fabric body in order of from a firstly formed unused-yarn-edge disposal loop to a finally formed unused-yarn-edge disposal loop, which is also one of the characteristic features of the present invention. According to the constitution of the present invention mentioned above, the unused-yarn-edge disposal loops are laid over the loops of the knitted fabric body in order of from the loop at a side far from the end of the unused yarn edge to the loop at the near side. This can allow the unused yarn edge to be held by the loops of the knitted fabric body in the state of extending substantially straight.

The knitted fabric having the unused yarn edge to be disposed may be a tubular knitted fabric whose front knitted fabric and back knitted fabric are continuously joined at both ends thereof, which is one of the characteristic features of the present invention. According to this constitution of the present invention, the unused-yarn-edge disposal loops laid over the loops of the knitted fabric body are advantageously hidden in the inside of the tubular knitted fabric.

Further, after the knitting yarn introduced in and/or drawn out is subjected to a knotting knitting to fixedly knot a basal end portion of the unused yarn edge to the knitted fabric body, the unused-yarn-edge disposal loops are moved to and laid over the loops of the knitted fabric body in order, which is one of the characteristic features of the present invention. According to this constitution of the present invention, the basal end of the unused yarn edge is fixed to the knitted fabric body by the knotting knitting, so that even when the knitted fabric is stretched, the unused yarn edge is restrained from being loosened and pulled out from the loops of the knitted fabric body.

BEST MODE FOR CARRYING OUT THE INVENTION

Preferred embodiments of the present invention will be described below with reference to the accompanying drawings. In the knitting course diagrams referred to in the following description, the numerals at the left side indicate the serial number of the courses, the capital alphabetical letters indicate the needles of the front bed, and the small alphabetical letters indicate the needles of the back bed. The vertical arrows at the right side indicate the direction for the loops to be transferred, and the horizontal arrows indicate the direction for the carriage to travel.

Figure 1:
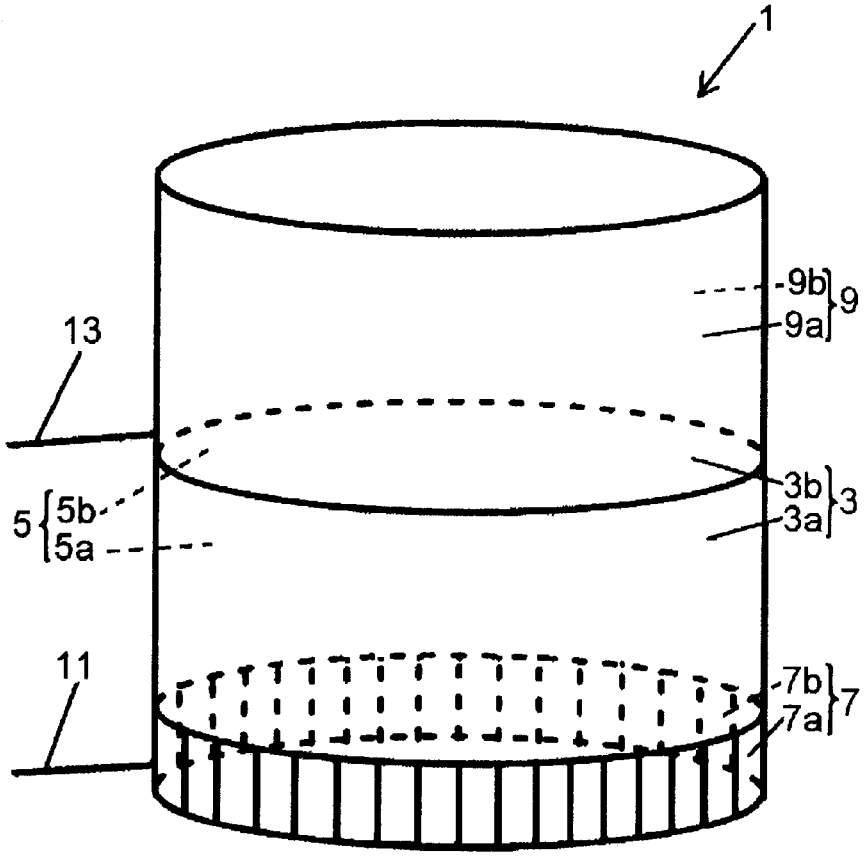
FIG. 1 shows a tubular knitted fabric knitted by the knitting method for disposing unused yarn edge of the present invention.

FIG. 1 shows a tubular knitted fabric 1 treated by the knitting method for disposing unused yarn edge of the present invention, with its unused yarn edges as yet uncut. The tubular knitted fabric 1 is formed by a front knitted fabric 3 and a back knitted fabric 5 being continuously joined at both ends thereof. In the tubular knitted fabric 1, a ribbed hem 7 comprising a front ribbed hem 7*a* formed in the front knitted fabric 3 and a back ribbed hem 7*b* formed in the back knitted fabric 5 and a plain weave fabric 9 comprising a front plain weave portion 9*a* formed in the front knitted fabric 3 and a back plain weave portion 9*b* formed in the back knitted fabric 5 are formed. The plain weave fabric 9 has lower half portions 3*a* and 5*a* and upper half portions 3*b* and 5*b*, which are knitted with different yarns. In the following embodiments, reference is given to a method for disposing an unused yarn edge 11 on the yarn-in side which is produced in the yarn-in operation wherein the knitting yarn used in knitting the lower half portions 3*a* and 5*a* is introduced in the knitting and an unused yarn edge 13 on the yarn-out side which is produced in the yarn-out operation.

First Embodiment

Figure 2:
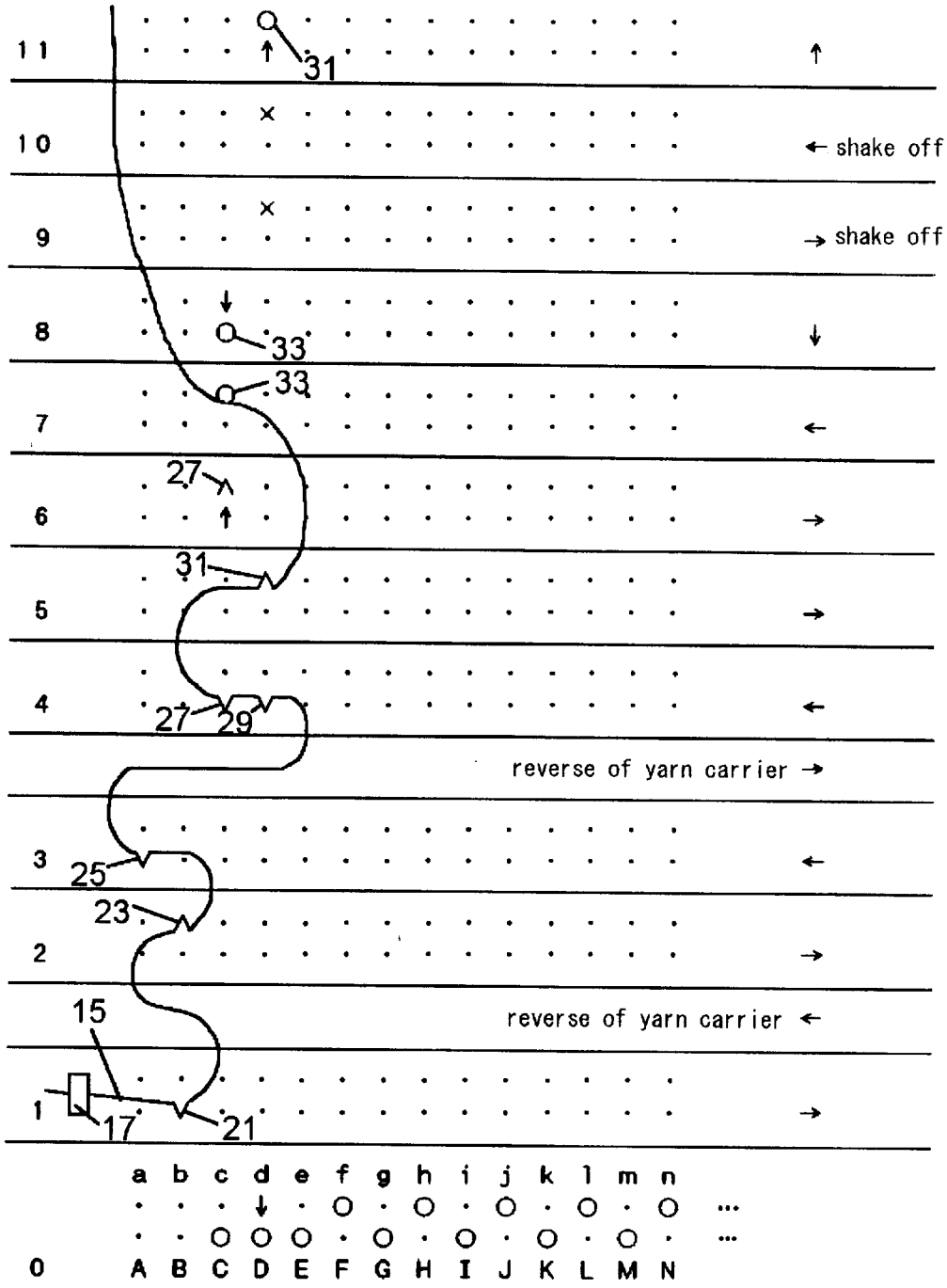
FIG. 2 is a knitting course diagram illustrating the first embodiment of the present invention.
Figure 3:
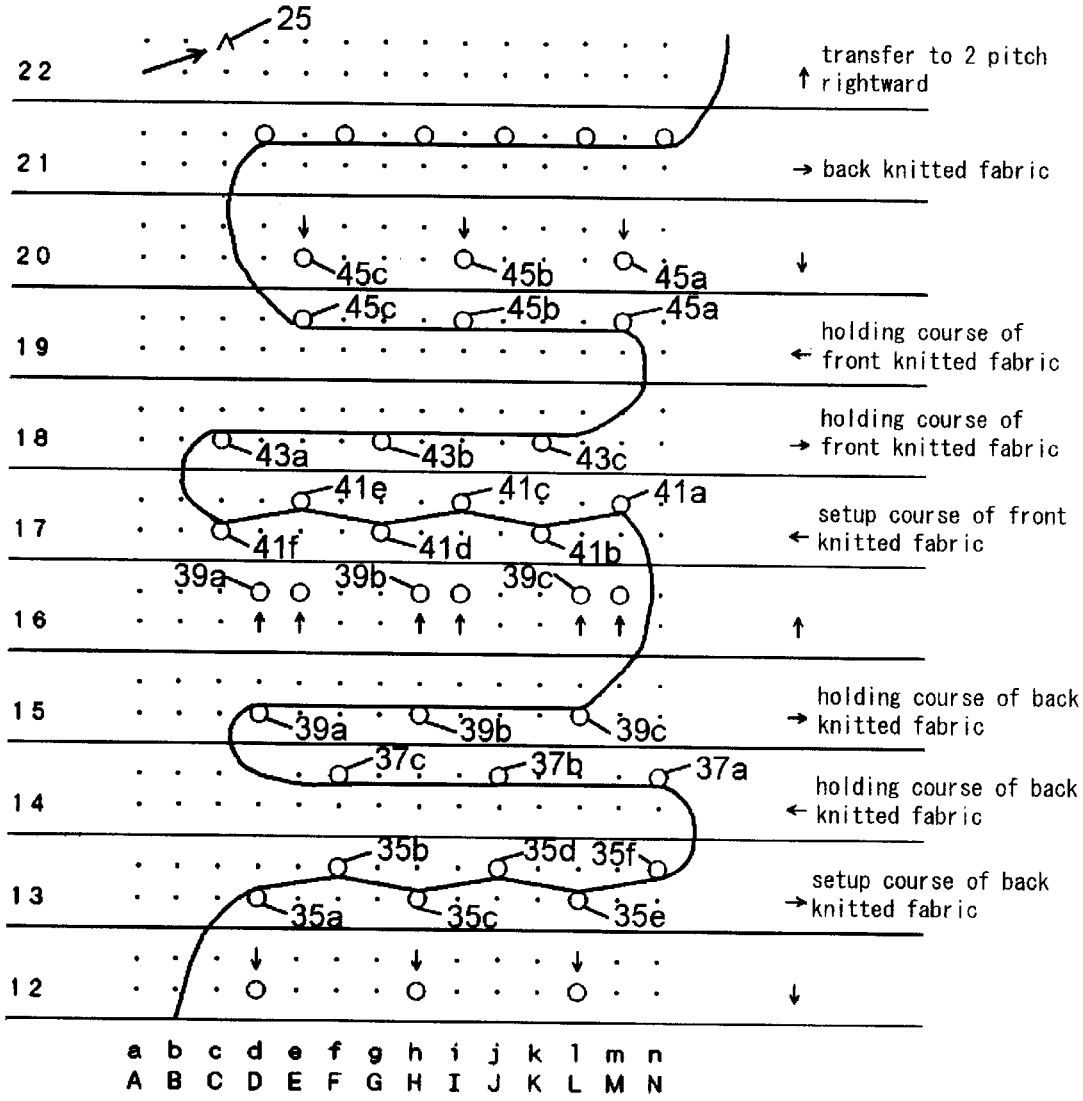
FIG. 3 is a knitting course diagram illustrating the first embodiment.
Figure 4:
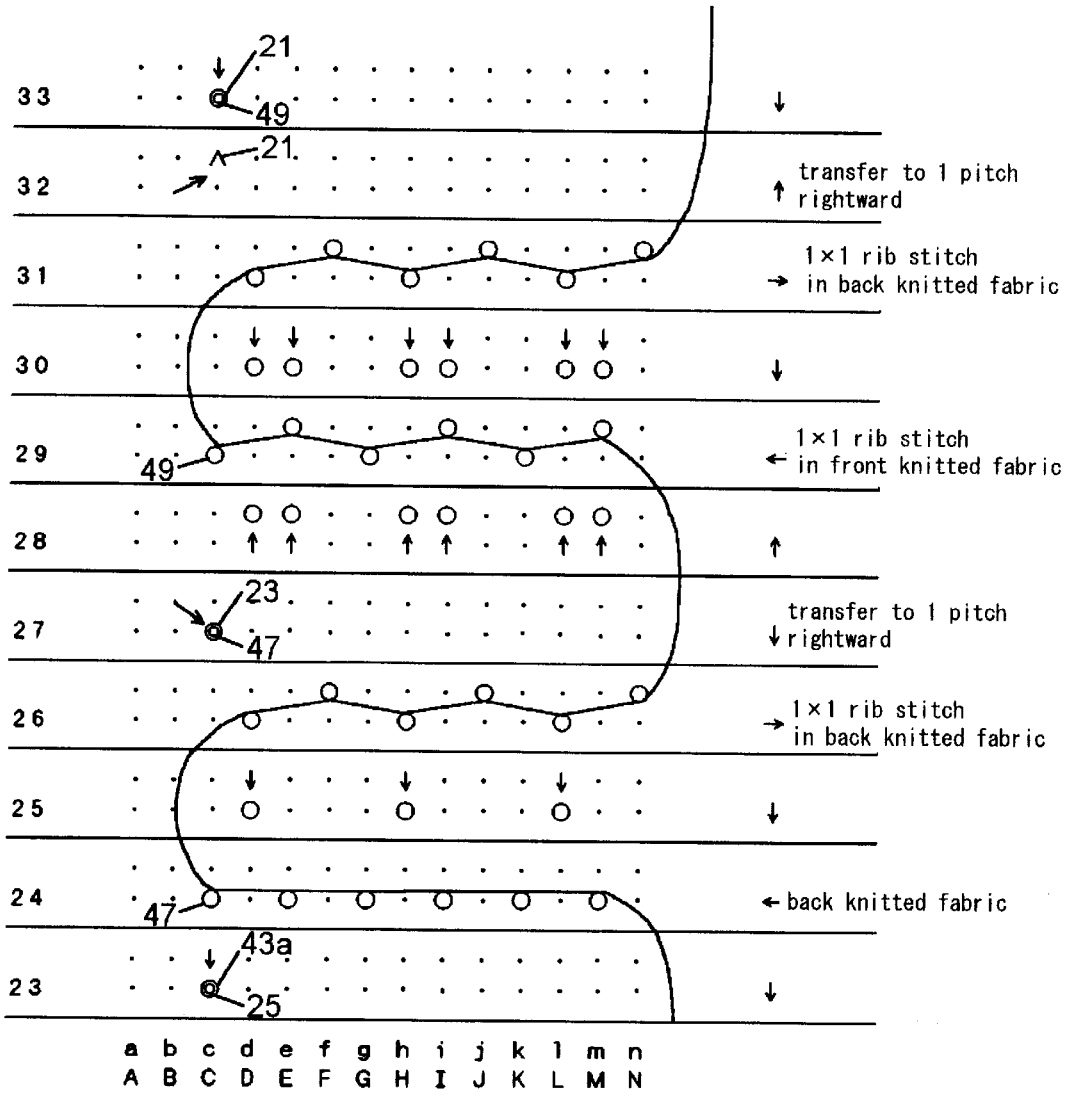
FIG. 4 is a knitting course diagram illustrating the first embodiment.
Figure 5:
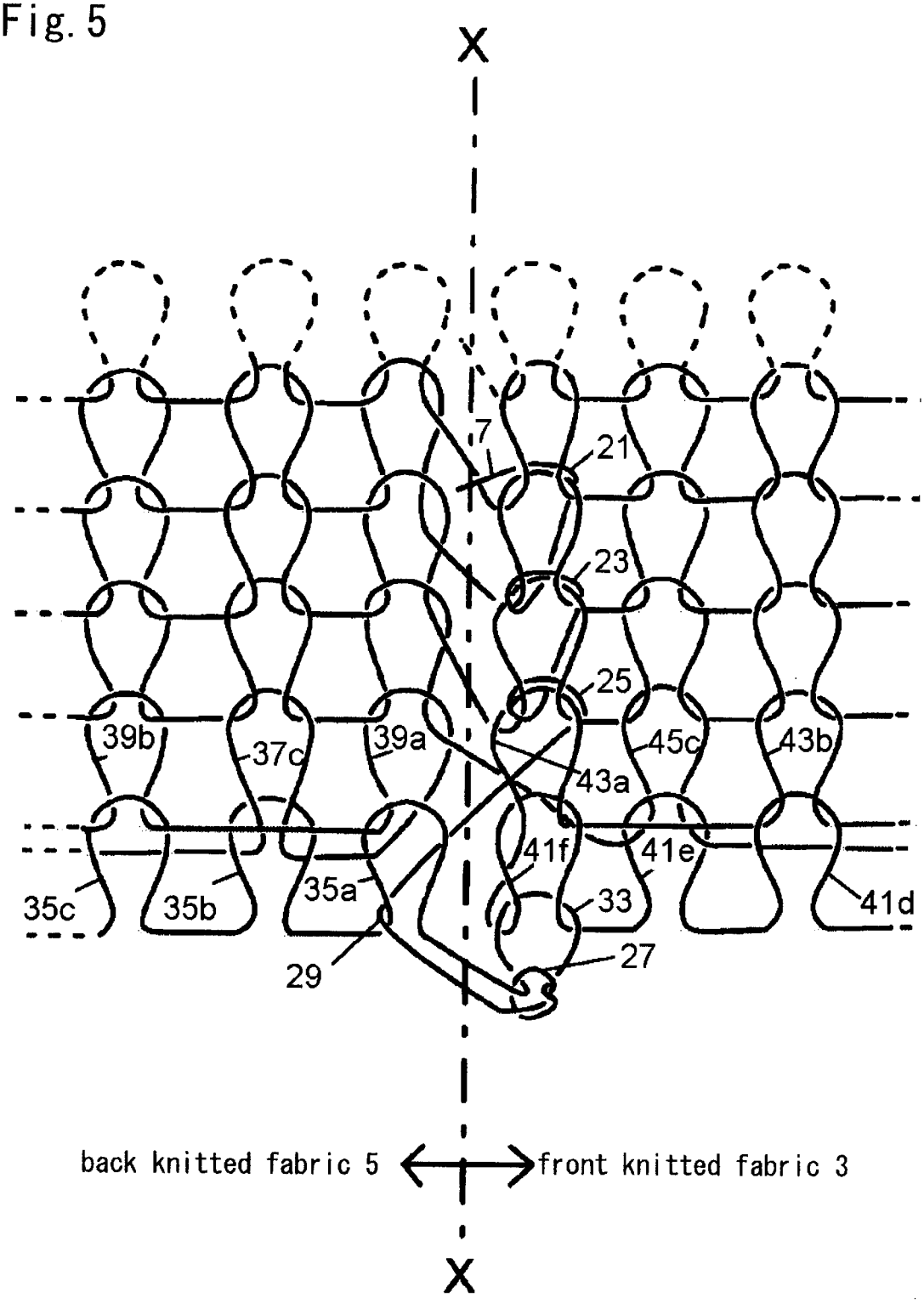
FIG. 5 is a looping diagram of the knitted fabric knitted by the method of the first embodiment.

In the first embodiment, the disposal of the unused yarn edge 11 on the yarn-in side is described with reference to FIGS. 1–5. FIGS. 2–4 are knitting course diagram illustrating the first embodiment. FIG. 5 is a looping diagram thereof. As will be understood from the following description, a two-bed flat knitting machine comprising only a pair of front and back needle beds is used in such a manner that odd needles are used for knitting the front knitted fabric and even needles are used for knitting the back knitted fabric, while reserving empty needles on the opposed needle bed, so that a interlock stitch fabric, such as a rib stitch fabric, can be knitted by using both of the front and back needle beds in the course of knitting the knitted fabric into a tubular shape. In the case where a multistage flat knitting machine including upper beds which are disposed over a pair of lower beds and on which transfer components, such as transfer jacks and transfer needles, are arranged with a corresponding needle pitch to those on the lower beds, is used, the tubular knitted fabric can be knitted without any empty needles being situated between the knitting needles for use in forming the loops.

The course 0 of FIG. 2 shows the state that a waste course knitting taken place prior to regular knitting is completed. After the completion of the knitting of the waste course, a desired knitted fabric (hereinafter it is referred to as the knitted fabric body) is knitted and then the waste course is separated and removed from the knitted fabric body (FIG. 1 shows the state that the waste course was separated and removed). The knitting of the waste course taken place prior to knitting the knitted fabric body can allow a pull-down tensile force to be exerted on the knitted fabric body from the first knitting course of the knitted fabric body. A knitting yarn 15 that is newly introduced from the course 1 into the knitting is held at its yarn end by a yarn end holding device 17 disposed at a lateral side of a knitting area and is extended through a yarn carrier (not shown) that moves in reciprocation along a needle gap between the both front and back needle beds. When the knitting is initiated, the knitting yarn 15 held at its yarn end is led to the knitting area by the yarn carrier and a portion of the knitting yarn extending between the yarn end and the carrier is captured by a hook of the needle and drawn in by it to do the knitting. The needles C–M of the front bed and the needles d–n of the back needle bed are used for knitting the knitted fabric body. The needles A and B located outside of those needles are used for the knitting process for disposing an unused yarn edge as described later. In the course 0, the loop on the needle d of the back bed is transferred to the needle D of the front bed in advance, for preparation of the next knitting.

In the course 1 of FIG. 2, the yarn carrier is shifted rightward and the yarn is fed to the needle B of the front bed situated next to the needle C on which the loop at the end side of the knitted fabric body is formed. At this time, no loop in the preceding course is formed on the needle B, so that the knitting yarn fed to the needle B comes into the state of being held in the hook of the needle B. For convenience of explanation, this knitting process wherein the knitting yarn is fed to the empty needle holding no loop, so as to be held in the hook of the needle is referred to as "the empty needle knitting process" in the embodiment, and the knitting yarn held in the needle by such an empty needle knitting process is referred to as "the empty needle knitting loop". The empty needle knitting loop 21 is held in the needle B of the front bed by the knitting of the course 1. Prior to going on to the knitting of the course 2, the yarn carrier is reversed in traveling direction and is shifted to the left side of the needle b to which the yarn is fed in the course 3. In the knitting of the course 2, the yarn carrier is shifted rightward and the yarn is fed to the needle b to form thereon the empty needle knitting loop 23 in the same manner as in the needle B. In the knitting of the course 3, the yarn carrier is reversed and the yarn is carried leftward and fed to the needle A of the front bed to form the empty needle knitting loop 25 therein. The knitting processes of the courses 1 to 3 form the first half of the knitting process for disposing the unused yarn edge, and the empty needle knitting loops 21, 23 and 25 formed in these knitting processes are each called "the unused-yarn-edge disposal loop". The first half of this knitting process may proceed, prior to forming the unused-yarn-edge disposal loop, as in this embodiment. Alternatively, it may proceed after the initiation of the knitting of the knitted fabric body by taking the step that the yarn is fed to the needle used for knitting the knitted fabric body, prior to forming the unused-yarn-edge disposal loop, and then the needle is moved up to the knitting yarn extending between the endmost side of the knitted fabric body and the yarn end to capture it into the hook of the needle. The remaining second half of the knitting process proceeds in parallel with the knitting of the courses of the knitted fabric body after the initiation of the knitting of the knitted fabric body.

Prior to the knitting of the course 4, the yarn carrier is reversed and shifted rightward. Thereafter, in the knitting of the course 4, the yarn is carried leftward and fed to the needles D and C of the front bed, to form the loops 27 and 29 thereon. In the knitting of the course 5, the yarn is carried rightward and fed to the needle d of the back bed, to form the loop 31 thereon. In the knitting of the course 6, the loop 27 on the needle C to which the yarn is fed in the knitting of the course 4 is transferred to the needle c of the back bed. In the knitting of the course 7, the yarn is carried leftward and fed to the needle c of the back bed, to form the loop 33 thereon. In the course 8, the loop 33 is transferred to the needle C of the front bed. Then, in the knitting of the courses 9 and 10, the needle D of the back bed holding the loop 31 formed in the knitting of the course 4 is advanced or retracted without feeding the yarn thereto, so as to shake off the held loop 31 from the needle D. In the knitting of the course 11, the loop 31 on the needle D of the front bed is transferred to the needle d of the back bed. The knitting processes of the courses 4–10 form the knotting knitting for the unused yarn edge extending out from the knitted fabric to be knotted at a basal end thereof so as to be tied on the knitted fabric body, so as to prevent the unused yarn edge from being drawn into the knitted fabric body even when force acts on the knitted fabric. It should be noted that the knotting knitting is not indispensable. The knotting knitting may selectively be made in accordance with knitting conditions, such as quality and thickness of the knitting yarn used and size of the loops formed, and the number of loops formed to dispose the unused yarn edge.

Then, the knitting of the knitted fabric body is started from the course 12 of FIG. 3. In the knitting of the course 12, prior to casting on a back knitted fabric of the knitted fabric body, the loops on the needles d, h and l of the back bed are transferred to the needles D, H and L of the front bed. Then, in the knitting of the course 13, the yarn is fed to the needles D, H and L of the front bed and the needles f, j and n of the back bed alternately, to form the loops 35*a*, 35*b*, 35*c*, 35*d*, 35*e* and 35*f* thereon. In the knitting of the course 14, the yarn is fed to the needles n, j and f of the back bed to form the loops 37*a*, 37*b* and 37*c* thereon. In the knitting of the course 15, the yarn is fed to the needles D, H and L of the front bed to form the loops 39*a*, 39*b* and 39*c* thereon, so as to prevent loosening of the stitches, and the back knitted fabric 1 is cast on. In the knitting of the course 16, the loops 39*a*, 39*b* and 39*c* of the back knitted fabric 5 held on the needles D, H and L of the front bed are transferred to the corresponding needles d, h and l of the back bed and, prior to casting on the front knitted fabric 3, the loops of a waste knitting portion held on the needles E, I and M of the front bed are transferred to the back bed. Then, in the knitting of the course 17, the yarn is fed to the needles C, G and K of the front bed and the needles e, i and m of the back bed alternately, to form the loops 41*a*, 41*b*, 41*c*, 41*d*, 41*e* and 41*f* thereon. In the knitting of the course 18, the yarn is fed to the needles C, G and K of the front bed to form the loops 43*a*, 43*b* and 43*c* thereon. In the knitting of the course 19, the yarn is fed to the needles m, i and e of the back bed to form the loops 45*a*, 45*b* and 45*c* thereon, so as to prevent loosening of the stitches of the front knitted fabric 3. Then, in the knitting of the course 20, the loops 45*a*, 45*b* and 45*c* of the front knitted fabric held on the needles e, i and m of the back bed are transferred to the needles E, I and M of the front bed, so that all loops of the front knitted fabric 3 are transferred to the front bed. In the knitting of the course 21, the yarn is fed to the needles D, F, H, J, L and N of the back bed to knit the back knitted fabric 5.

Then, in the knitting of the course 22 at which the second half of the knitting process for disposing the unused yarn edge is initiated, the unused-yarn-edge disposal loop 25 formed in the needle A of the front bed by the empty needle knitting process in the knitting of the course 3 is transferred to the needle c of the back bed. In the knitting of the course 23 of FIG. 4, the unused-yarn-edge disposal loop 25 is further transferred to the needle C of the front bed and laid over the loop 43*a* of the front knitted fabric 3 held on the needle C. Then, in the knitting of the course 24, the yarn is fed to the needles M, K, I, G, E and C of the front bed to knit the front knitted fabric 3. In the knitting of the course 25, the loops of the back knitted fabric 5 held on the needles d, h and l of the back bed are transferred to the needles D, H and L of the front bed, for preparation of knitting the back knitted fabric 5 in the form of a 1×1 rib stitch structure. Then, in the knitting of the course 26, the yarn is fed to the needles D, H and L of the front bed and the needles f, j and n of the back bed to knit the back knitted fabric 5 in the form of the 1×1 rib stitch structure. In the knitting of the course 27, the unused-yarn-edge disposal loop 23 formed in the course 2 and held on the needle b of the back bed is transferred to the needle C of the front bed and laid over the loop 47 of the front knitted fabric 3. In the knitting of the course 28, the loops of the back knitted fabric 5 held on the needles D, H and L of the front bed are transferred back to the needles d, h and l of the back bed and also the loops of the front knitted fabric 3 held on the needles E, I and M of the front bed are transferred to the needles e, i and m of the back bed, for preparation of knitting the front knitted fabric 3 in the form of the 1×1 rib stitch structure. In the knitting of the course 29, the yarn is fed to the needles e, i and m of the back bed and the needles C, G and K of the front bed alternately, to knit the front knitted fabric 3 in the form of the rib stitch structure. In the knitting of the course 30, the loops of the front knitted fabric 3 transferred to the back bed and the loops of the back knitted fabric 5 formed as the back stitches are transferred to the front bed. In the knitting of the course 31, the yarn is fed to the needles D, H and L of the front bed and the needles f, j and n of the back bed alternately, to knit the back knitted fabric 5 in the form of the rib stitch structure. In the knitting of the course 32, the unused-yarn-edge disposal loop 21 held on the needle B formed in the knitting of the course 1 is transferred to the needle c of the back bed. In the course 33, the unused-yarn-edge disposal loop 21 is further transferred to the needle C of the front bed and laid over the loop 49 of the front knitted fabric 3. The knitting processes of the courses 22, 23, 27, 32 and 33 form the second half of the knitting process for disposing the unused yarn edge. The knitting process wherein the unused-yarn-edge disposal loops 21, 23 and 25 formed prior to knitting the knitted fabric body in the first half of the knitting process for disposing the unused yarn edge are laid over the loops of the knitted fabric body in order of from the finally formed loop 25 to the firstly formed loop 21 proceeds in parallel with the knitting of the knitted fabric body. Subsequently, the knitting processes illustrated in the courses 28 to 31 are repeated to form the rib stitch 7 of the tubular knitted fabric 1 shown in FIG. 1.

The looping diagram of the knitted fabric knitted by the knitting method described above is shown in FIG. 5. FIG. 5 shows only the loops formed by the knitting the courses starting from the course 1 of FIG. 2, with the loops formed by knitting the waste course omitted. The dashed line X—X indicates a boundary between the front knitted fabric 3 and the back knitted fabric 5. The front knitted fabric 3 is on the right hand of the line X—X, and the back knitted fabric 5 is on the left hand of the same. As shown in FIG. 5, with its unused yarn edge disposed by the knitting method as mentioned above, the knitted fabric comes into the state in which the unused-yarn-edge disposal loops 21, 23 and 25 formed in the unused yarn edge in the first half of the knitting of the courses 1 to 3 are held by the loops of the knitted fabric body.

When the knitting by the flat knitting machine is completed, the unused yarn edge 11 at which no loop is formed in a cast-on portion of the knitted fabric body 1 is in the state of extending out from the knitted fabric, as shown in FIG. 1. In this state of the knitted fabric, the unused yarn edge 11 is cut at its portion close to the knitted fabric. The unused yarn edge 11 thus treated is held in the form of the unused-yarn-edge disposal loops 21, 23 and 25 by the loops of the knitted fabric body. Thus, the unused yarn edge 11 comes into the state of being accommodated in the knitted fabric as if it is linked into the knitted fabric. Consequently, the need of linking the unused yarn edge into the knitted fabric separately can be eliminated. Further, in the embodiment mentioned above, following the knitting process for disposing the unused yarn edge, the knotting knitting is performed, prior to knitting the knitted fabric body. Accordingly, closing the loop 27 by pulling the unused yarn edge in a drawing direction prior to cutting it can make it hard for the unused yarn edge 11 to be drawn into the knitted fabric body.

Second Embodiment

Figure 6:
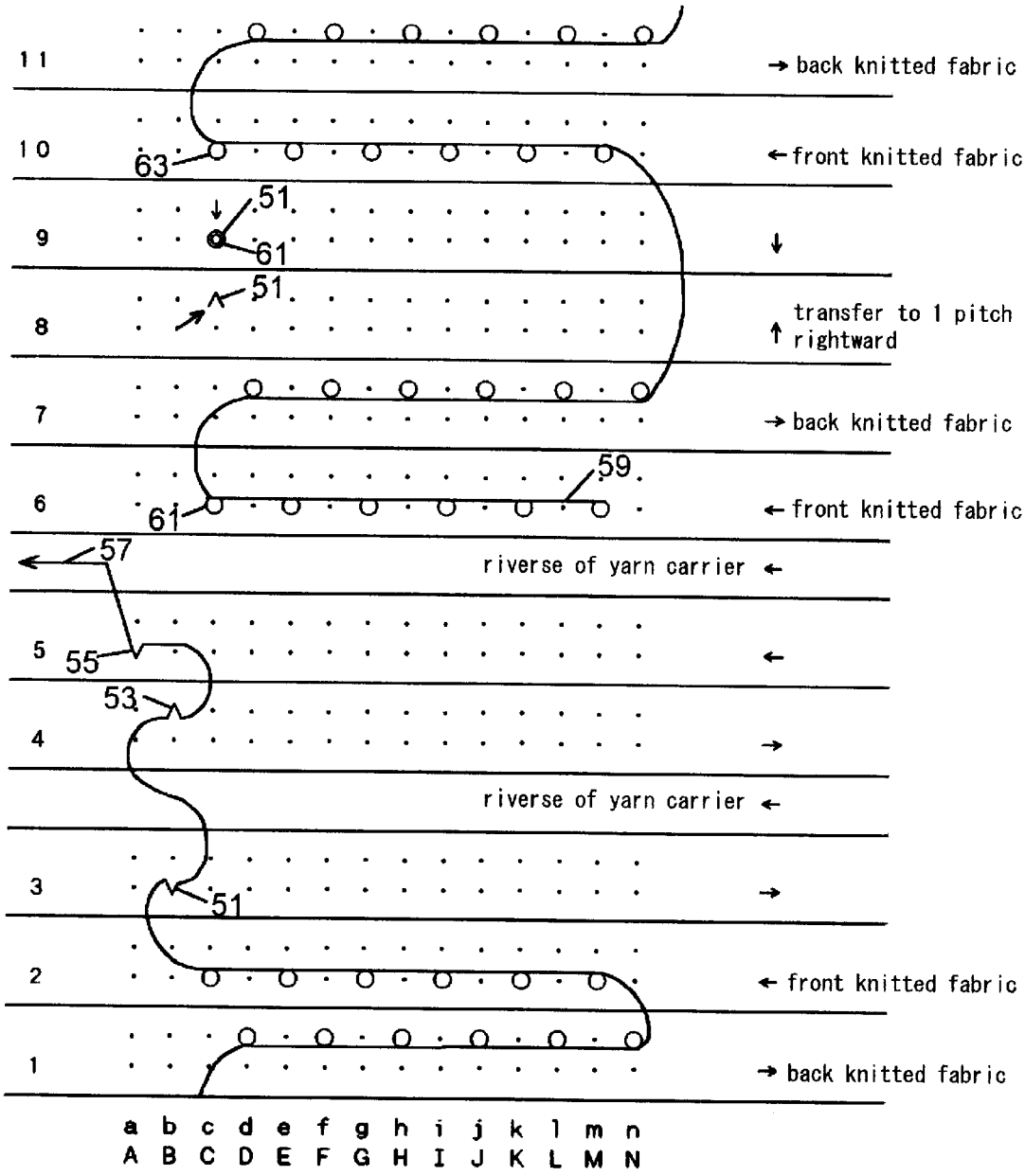
FIG. 6 is a knitting course diagram illustrating the second embodiment.
Figure 7:
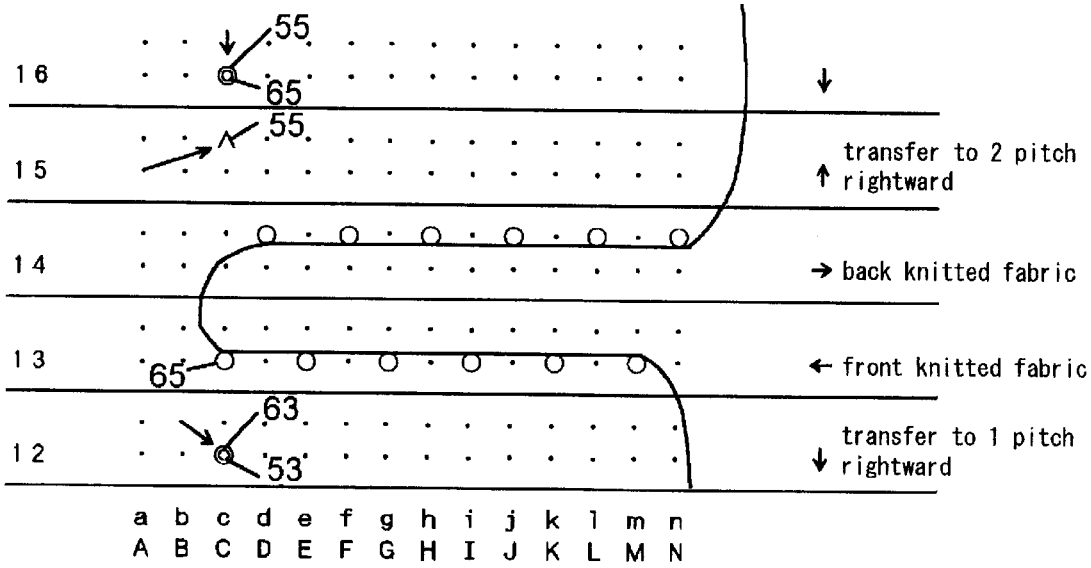
FIG. 7 is a knitting course diagram illustrating the second embodiment.
Figure 8:
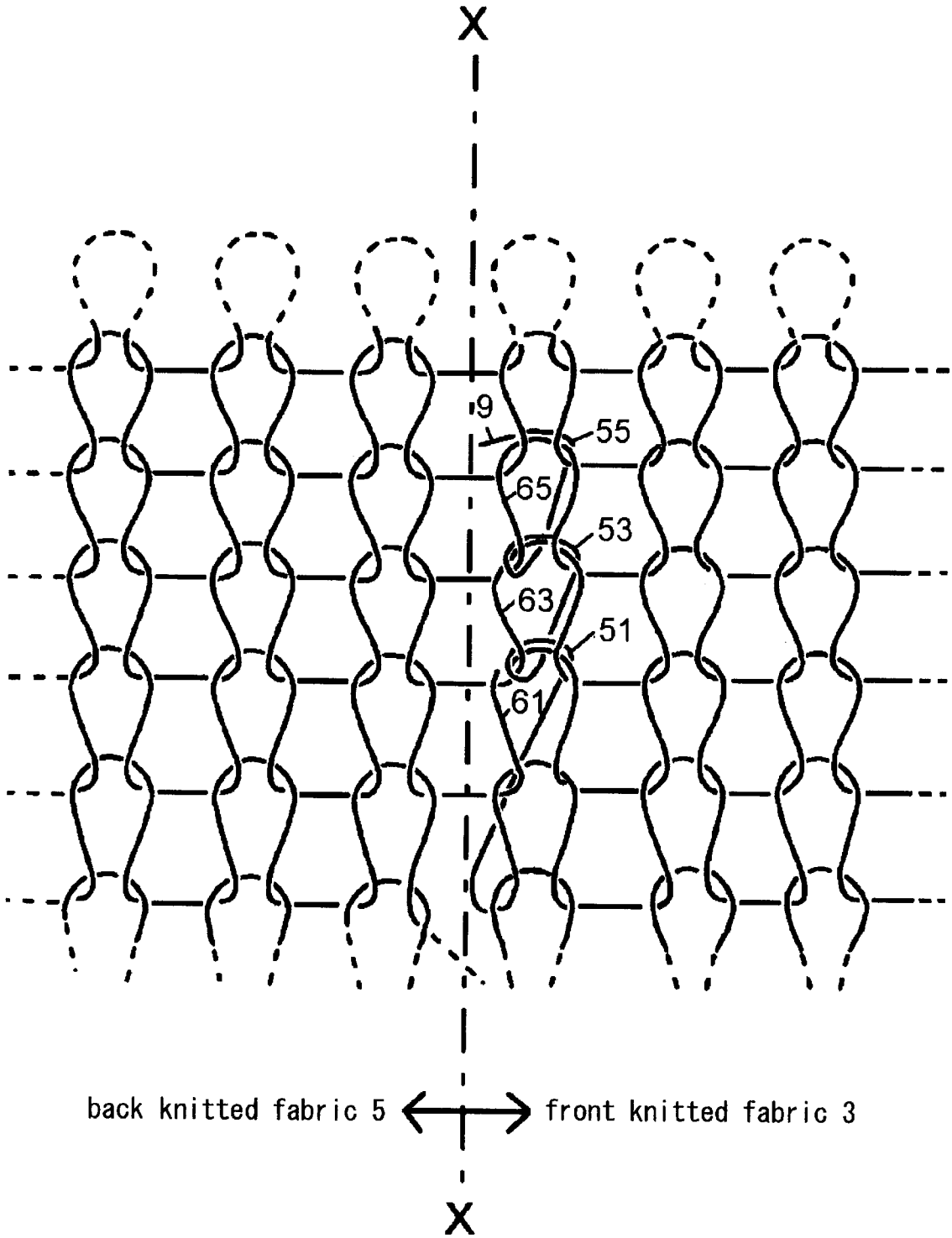
FIG. 8 is a looping diagram of the knitted fabric knitted by the method of the second embodiment.

Next, the disposal of the unused yarn edge 13 on the knit-up side is described with reference to FIGS. 6–8. FIGS. 6–7 are knitting course diagrams illustrating the second embodiment and FIG. 8 is a looping diagram of the same. The second embodiment provides the knitting method for disposing the unused yarn edge 13 which is produced in the yarn-out operation performed in the course of the plain weave portion 7 of the tubular knitted fabric 1 being knitted by repeating the knitting of the courses 1 to 2 of FIG. 6. In the courses 3 to 5 of FIG. 6 in which the knitting for disposing the unused yarn edge is performed, the same knitting as in the knitting of the courses 1 to 3 of the first embodiment is performed by using the knitting yarn subjected to the yarn-out operation, so as to form the unused-yarn-edge disposal loops 51, 53 and 55. After the completion of the knitting of the course 5, the knitting yarn 57 used in the knitting of the lower half of the tubular knitted fabric 1 is moved out of the knitting area. Then, in the knitting of the course 6, the front knitted fabric 3 is knitted by using the different knitting yarn 59 used in the next knitting of the upper half of the tubular knitted fabric 1. In the knitting of the course 7, the back knitted fabric 5 is knitted by using the same knitting yarn. Then, in the knitting of the course 8, the unused-yarn-edge disposal loop 51 formed in the knitting of the course 3 is transferred to the needle c of the back bed. In the knitting of the course 9, it is transferred to the needle C of the front bed and laid over the loop 61 of the knitted fabric body. Then, in the knitting of the course 10, the front knitted fabric 3 is knitted, and in the knitting of the course 11, the back knitted fabric 5. In the knitting of the course 12 of FIG. 7, the unused-yarn-edge disposal loop 53 formed in the knitting of the course 4 is transferred to the needle C of the front bed and laid over the loop 63 of the knitted fabric body. In the knitting of the course 13, the front knitted fabric 3 is knitted, and in the knitting of the course 14, the back knitted fabric 5 is knitted. In the knitting of the course 15, the unused-yarn-edge disposal loop 55 formed in the knitting of the course 5 is transferred to the needle c of the back bed. In the knitting of the course 17, it is transferred to the needle C of the front bed and laid over the loop 65 of the knitted fabric body.

In the second embodiment, the unused-yarn-edge disposal loops 51, 53 and 55 are laid over the loops of the knitted fabric body in order of from the firstly formed loop 51 to the finally formed loop 55. Although the second embodiment is different in this aspect from the first embodiment in which the unused-yarn-edge disposal loops are laid over the loops of the knitted fabric body in order of from the finally formed loop to the firstly formed loop, it is common to the first embodiment in that the unused-yarn-edge disposal loops are laid over the loops of the knitted fabric body in order of from the loop at a side far from the end of the unused yarn edge to the loop at the near side. In the knitted fabric knitted in the second embodiment, since the unused-yarn-edge disposal loops 51, 53 and 55 are held by the loops 61, 63 and 65 of the knitted fabric body, the unused yarn edge can be disposed by simply cutting the unused yarn edge at its portion close to the knitted fabric, as is the case with the yarn-in operation. Although the knotting knitting is not involved in the second embodiment, it may be added, if required. In that case, the knotting knitting should be performed after completion of the knitting of the course 2.

While in the both embodiments illustrated above, the unused-yarn-edge disposal loops are laid over the loops of the same wale of the knitted fabric body at the endmost side of the knitted fabric body so that the unused yarn edge can be knitted into the knitted fabric without particular distinction, the unused-yarn-edge disposal loops may be laid over the loops of the other wale of the knitted fabric body. While three unused-yarn-edge disposal loops are formed in the embodiments, the number of unused-yarn-edge disposal loops formed is not limited to three. While the loop of the knitted fabric body is laid over the unused-yarn-edge disposal loop at each time one course of the knitted fabric body is formed, it may be laid over the unused-yarn-edge disposal loop at each time two or more courses of the knitted fabric body are formed. Further, the unused-yarn-edge disposal loop may be laid over the loop of the back knitted fabric. Also, while in the embodiments described above, the knitted fabric body is knitted in the form of the tubular knitted fabric, it may be knitted in any other form, without being limited thereto. The embodiments described above are just taken as an example of the embodied forms of the present invention. The method of the present invention is not limited to those disclosed in the embodiments and modifications may be made in the invention, without departing from the spirit and scope of the invention.

Capabilities of Exploitation in Industry

As mentioned above, in the knitted fabric as was treated by the knitting method for disposing the unused yarn edge of the present invention, the unused yarn edge of the knitting yarn as was subjected to the yarn-in operation and/or the yarn-out operation in brought into the state in which a portion of the unused yarn edge that is formed into the form of the unused-yarn-edge disposal loops is held in the knitted fabric by the loops of the knitted fabric body. This can allow the unused yarn edge to be disposed by simply cutting it at its portion close to the knitted fabric, without the troublesome work including the linking. In the case where the knitted fabric having the unused yarn edge to be disposed is the tubular knitted fabric whose front knitted fabric and back knitted fabric are continuously joined at both ends thereof, the unused-yarn-edge disposal loops are advantageously hidden in the inside of knitted fabric areas between the front knitted fabric and the back knitted fabric. Further, when the unused-yarn-edge disposal loops are moved to and laid over the loops of the knitted fabric body in order after the knotting knitting is performed, the basal end of the unused yarn edge is fixed to the knitted fabric body by the knotting, so that even when the knitted fabric is stretched, the unused yarn edge is restrained from being pulled out from the loops of the knitted fabric body.

What is claimed is:

1. A knitting method for disposing an unused yarn edge produced in at least one of a yarn-in or a yarn-out operation in which a knitting yarn is used in knitting a knitted fabric by using a flat knitting machine having at least a pair of front and back needle beds, either or both of which are movable in a longitudinal direction thereof, the knitting method comprising the steps of:

(a) forming two or more unused-yarn-edge disposal loops from the knitting yarn introduced in or drawn out in knitting by using an empty needle around an end side of a knitted fabric body; and (b) moving the unused-yarn-edge disposal loops thus formed and laying each of the unused-yarn-edge disposal loops over loops of different courses of the knitted fabric body located at an end side thereof in knitting the next course of the knitted fabric body.

2. The knitting method for disposing an unused yarn edge according to claim 1, wherein the unused yarn edge to be disposed is the unused yarn edge is on the yarn-in side produced in the yarn-in operation and wherein step (b) proceeds in order from a finally formed unused-yarn-edge disposal loop to a firstly formed unused-yarn-edge disposal loop.

3. The knitting method for disposing an unused yarn edge according to claim 1, wherein the unused yarn edge to be disposed is the unused yarn edge on the yarn-out side produced in the yarn-out operation and wherein step (b) proceeds in order from a firstly formed unused-yarn-edge disposal loop to a finally formed unused-yarn-edge disposal loop.

4. The knitting method for disposing an unused yarn edge according to claim 1, wherein the knitted fabric having the unused yarn edge to be disposed is a tubular knitted fabric whose knitted fabric and back knitted fabric are continuously joined at both ends thereof.

5. The knitting method for disposing an unused yarn edge according to claim 1, wherein after the knitting yarn introduced in and/or drawn out is subjected to a knotting knitting to fixedly knot a basal end portion of the unused yarn edge to the knitted fabric body, the unused-yarn-edge disposal loops are moved to and laid over the loops of the knitted fabric body in order.

* * * * *